US010954727B1

(12) United States Patent
Biem et al.

(10) Patent No.: US 10,954,727 B1
(45) Date of Patent: Mar. 23, 2021

(54) DUAL-WEAR PAD FOR DOWNHOLE DRILLING HOUSINGS

(71) Applicant: Nabors Drilling Technologies USA, Inc., Houston, TX (US)

(72) Inventors: Andrew Biem, Conroe, TX (US); Jean-Marc Tetevuide, Conroe, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 16/230,621

(22) Filed: Dec. 21, 2018

Related U.S. Application Data

(60) Provisional application No. 62/609,271, filed on Dec. 21, 2017.

(51) Int. Cl.
*E21B 17/10* (2006.01)
*E21B 17/20* (2006.01)

(52) U.S. Cl.
CPC ..... *E21B 17/1085* (2013.01); *E21B 17/20* (2013.01)

(58) Field of Classification Search
CPC ..... E21B 17/1085; E21B 17/10; B23K 10/00
See application file for complete search history.

(56) References Cited

U.S. PATENT DOCUMENTS 4,467,879 A * 8/1984 Burge ..... E21B 17/22 175/325.4
5,139,094 A * 8/1992 Prevedel ..... E21B 7/068 175/61
5,180,021 A * 1/1993 Champion ..... E21B 7/06 175/325.2
2006/0113113 A1* 6/2006 Underwood ..... E21B 7/067 175/61
2013/0273258 A1* 10/2013 Luce ..... B05B 7/222 427/446

FOREIGN PATENT DOCUMENTS

WO WO-2016028662 A1 * 2/2016 ..... C21D 9/22

OTHER PUBLICATIONS

Plasma Technology Automation & Materials; "PT-MAT™-Dia Tile;" [Spec Sheet]; (May 30, 2016); 1 page.
Plasma Technology Automation & Materials; "PT-MAT™P-65355;" [ Spec Sheet] ; (Apr. 18, 2019); 1 page.

* cited by examiner

*Primary Examiner* — Giovanna Wright
*Assistant Examiner* — Dany E Akakpo

(57) ABSTRACT

A wear pad for a drill pipe body of downhole drilling assembly comprising at least one wear insert and a wear pad material that at least partially encases the at least one wear insert. The wear inserts can be supported by or attached to an insert support structure of the drill pipe body. The insert support structure and the wear inserts can be welded over by the wear pad material to at least partially encase the wear inserts (e.g., using a plasma transfer arc welding tool). The wear inserts can comprise tungsten carbide impregnated with industrial diamonds, and the wear pad material can comprise tungsten carbide, the wear inserts comprising an overall hardness greater than the hardness of the wear pad material. A second wear pad can be formed adjacent to, and have similar features as, the wear pad. The wear pads can be separated by or located on opposite sides of a bend portion of a bent housing drill assembly.

37 Claims, 8 Drawing Sheets

DUAL-WEAR PAD FOR DOWNHOLE DRILLING HOUSINGS

RELATED APPLICATIONS

This application claims the benefit of U.S. Provisional Patent Application No. 62/609,271, filed Dec. 21, 2017, which application is incorporated by reference herein in its entirety.

BACKGROUND

Current wear pad technology used with downhole drilling pipes are deficient in that the wear pads do not provide adequate wear resistance in highly abrasive drilling applications. Existing wear pads often fail or "wear down" too quickly, thereby causing damage to drill pipes, which can lead to down-time during drilling operations. Solutions to address these issues with existing wear pads have proven costly and undesirable, for a variety of reasons.

In directional drilling, a bent housing drilling assembly has a bend portion between drill pipe sections to assist with steering the assembly during downhole drilling. Such bent housing drilling assemblies typically have a number of protection layers in order to prolong the life of the bent housing, such as the type of wear pads discussed above. As indicated, these can fail or wear down at an undesirable rate. Moreover, just a single wear pad is typically formed adjacent and above the bend portion (opposite the drill head). This can expose portions of the dill pipe (below the bend portion) to damage due to wear on the drill pipe from the earth's crust while drilling.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
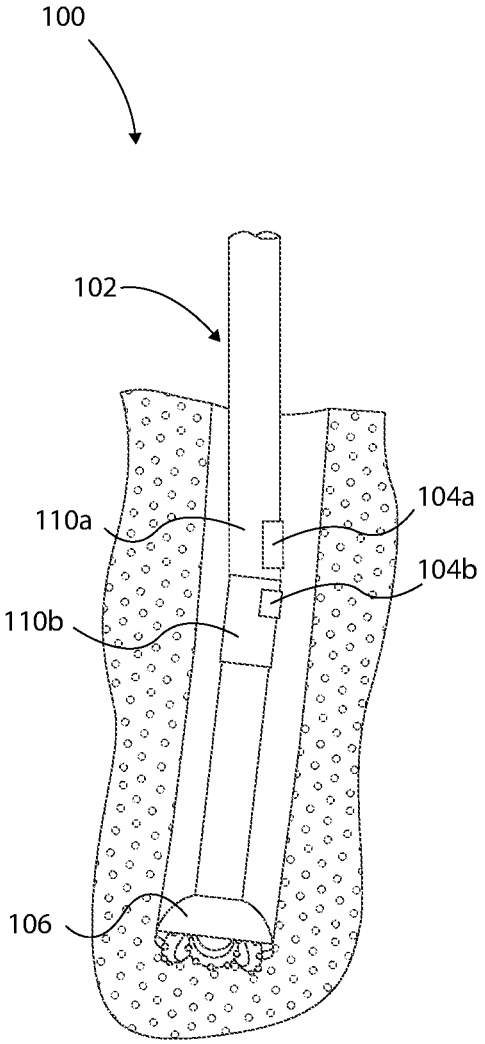
FIG. 1 illustrates a downhole drilling assembly as comprising a drill pipe body having dual wear pads on different sections of the drill pipe body, namely first and second pipe sections as separated by a bend portion, in accordance with an example of the present disclosure.

Reference will now be made to the exemplary examples illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology examples is provided below and then specific technology examples are described in further detail later. This initial summary is intended to aid readers in understanding the technology more quickly but is not intended to identify key features or essential features of the technology nor is it intended to limit the scope of the claimed subject matter.

The present disclosure sets forth a drill pipe having a wear pad for resisting wear during downhole drilling; the drill pipe comprising a drill pipe body; and a wear pad upset from the drill pipe body, the wear pad comprising at least one wear insert and a wear pad material that at least partially encases the at least one wear insert, wherein the at least one wear insert comprises a hardness greater than a hardness of the wear pad material.

The present disclosure also sets forth a bent housing drill assembly having dual-wear pads to resist wear during downhole drilling, the bent house drill assembly comprising a drill pipe body having a first pipe section and a second pipe section separated by a bend portion; a first wear pad upset from the first pipe section; and a second wear pad upset from the second pipe section, wherein at least one of the wear pads comprises at least one wear insert and a wear pad material that at least partially encases the at least one wear insert.

The present disclosure further sets forth a method of forming a wear pad on a drill pipe to resist wear during downhole drilling, the method comprising providing a drill pipe body; mounting at least one wear insert to the drill pipe body; and encasing the at least one wear insert with a wear pad material to form a wear pad upset from the drill pipe body.

Figure 2:
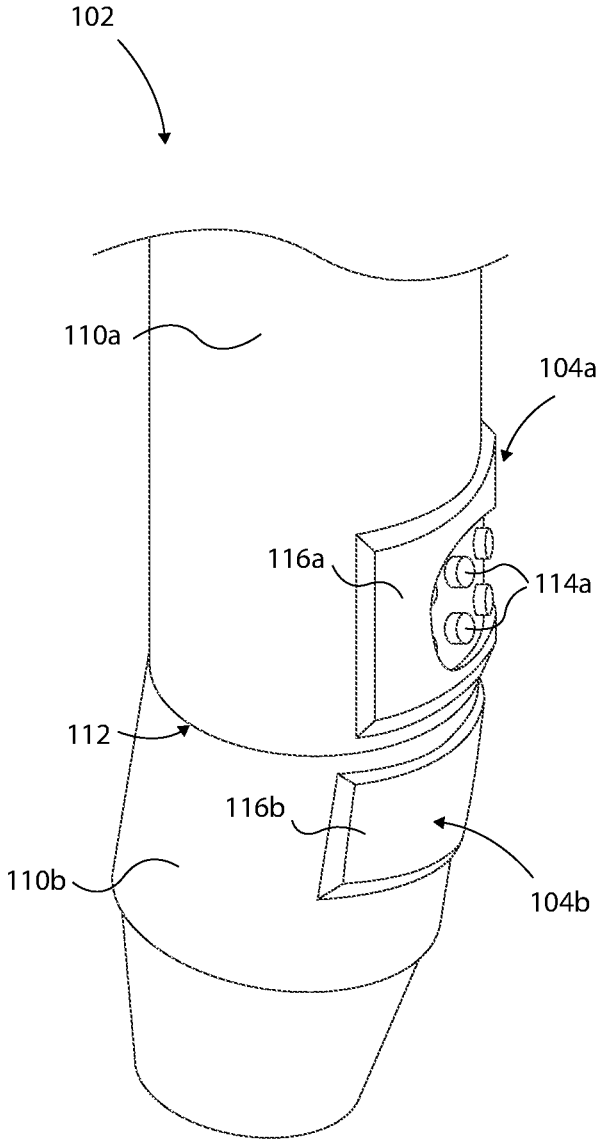
FIG. 2 illustrates a partial isometric view of the drill pipe body of FIG. 1 and the first and second wear pads.

FIGS. 1 and 2 illustrate a portion of a drill assembly 100 comprising a drill pipe body 102 having first and second wear pads 104*a* and 104*b* (e.g.; dual-wear pads) in accordance with an example of the present disclosure. The drill assembly 100 can comprise a bent housing drill assembly (with a mud motor) for directional drilling and that includes a rotary motor assembly 106 (e.g., fluid-driven) that turns the drill bit independent of drill string rotation. The drill pipe body 102 can comprise a first pipe section 110*a* and a second pipe section 110*b*, as well as a bend portion 112. The bend portion 112 can comprise and define a transition section that changes the orientation of the longitudinal axis of the drill assembly 100, and particularly of the drill pipe body 102, specifically from the orientation found in the first pipe section 110*a* to a different orientation as found in the second pipe section 110*b*. The drill pipe body 102 can comprise a number of different types and configurations of drill pipe. In one example, the drill pipe body 102 can comprise a 5 inch outside diameter casing used for wellbore drilling into the earth's crust as shown. This is not intended to be limiting as those skilled in the art will recognize other types of drill pipes that can be used.

The first wear pad 104*a* can be attached to, formed on, or otherwise supported by or about the first pipe section 110*a*, and the second wear pad 104*b* can be similarly attached to, formed on or otherwise supported by or about the second pipe section 110*b*, thereby forming a dual-wear pad configuration on the drill pipe body 102 with the first and second wear pads 104*a*,104*b* positioned adjacent or proximate the bend portion 112. The wear pads 104*a* and 104*b* can be formed, such that they extend from or rise above or are upset from the exterior surface of the drill pipe body 102 (e.g., FIG. 4A), and are configured to function on the drill pipe body 102, such as to resist wear during directional drilling to prevent wear (e.g., holes or other surface damage) to the drill pipe body 102.

One or both of the wear pads 104*a* and 104*b* can comprise a plurality of wear inserts (for example, see wear inserts 114*a* as part of the first wear pad 104*a*, these not being shown in the second wear pad 104*b*, although being a part thereof). In one example, the wear inserts 114*a* of the first wear pad 104*a* can be configured and arranged as shown in FIG. 2. In one aspect, the wear inserts 114*a* can be comprised of tungsten carbide material impregnated with industrial diamonds, for example.

The plurality of wear inserts 114*a* can be at least partially encased within a wear pad material or medium 116*a*. In one example, the wear pad material can comprise a hard metal, such as a tungsten carbide material, and more specifically a tungsten carbide material having a given ratio of spherical tungsten carbide particles to a matrix. For instance, the wear pad material can comprise a ratio of around 2:1 tungsten carbide particles to matrix (or around 65 percent tungsten carbide particles within a 35 percent matrix). The wear pad material can comprise other materials or material compositions, such as nickel, aluminum, bronze, or ceramics.

As further discussed below, the wear inserts can have a first hardness, and the wear pad material can have a second hardness, where the first hardness is greater than the second hardness, or in other words, wherein the wear inserts comprise a hardness that is greater than a hardness of the wear pad material. Thus, the wear pad material can comprise a primary wear component while the wear inserts can provide a secondary wear component. This arrangement can dramatically improve the wear resistance characteristics of the wear pads 104*a* and 104*b* over prior related wear pads, thus prolonging their life, and in turn prolonging the life of the pipe assembly 100 (e.g., as compared to the life of wear pads on a 5 inch drill pipe that only comprise a single material, such as a uniform pad body of tungsten carbide material).

The second wear pad 104*b* can be formed such that it is positioned or located below, and proximate the bend portion 112. The second wear pad 104*b* can further be positioned on a side of the bend portion 112 opposite the first wear pad 104*a*, such that the bend portion 112 is located between the first and second wear pads 104*a*,104*b*, as shown. Existing drill pipe assemblies typically comprise a single wear pad disposed above the bend portion of a bent housing drill assembly. Unlike existing drill pipe assemblies, the second wear pad 104*b* disclosed herein advantageously provides additional or supplemental wear protection to the pipe body 102, and particularly at a location (i.e., below the bend) that may frequently experience wear, such as during directional drilling. Providing first and second wear pads 104*a*,104*b* can also function to dramatically improve the wear characteristics of the drill assembly 100, thus prolonging the life of the drill pipe body 102, and also prolonging the life of the drill assembly 100 (as compared to bent housing drill assemblies that only have a single wear pad positioned adjacent/above the bend portion).

FIGS. 3A-30 illustrate a portion of the drill pipe body 102 of FIGS. 1 and 2, as well as illustrating, in part, a method of forming the wear pads 104*a* and 104*b* in accordance with an example of the present disclosure. With reference to FIGS. 1-48, and as discussed above, the drill pipe body 102 can comprise a first pipe section 110*a*, a second pipe section 110*b*, and a bend portion 112, the bend portion 112 defining a change in a longitudinal axis and direction of the drill pipe body 102.

As shown, the wear pads 104*a*,104*b* can comprise first and second insert support structures 118*a* and 118*b* positioned on or about the drill pipe body 102. In one aspect, the insert support structures 118*a*,118*b* can comprise separate structural members that can be joined or otherwise coupled (e.g., welded, brazed, etc.) to the drill pipe body 102. In another aspect, the insert support structures 118*a*,118*b* can comprise a material deposited on and built-up, such that they are formed on the drill pipe body 102. As such, the insert support structures 118*a*,118*b* can be attached or otherwise joined to or formed on respective pipe sections 110*a* and 110*b*.

The insert support structures 118*a* and 118*b* can each comprise a base defining a cavity area (e.g., see bases and cavity areas 120*a* and 120*b*, respectively). Each base or cavity area 120*a* and 120*b* can comprise a plurality of pockets (e.g., see pockets 122*a* and 122*b*, respectively) configured to receive therein, and which can provide at least a degree of structural support to, a plurality of inserts (e.g., see inserts 114*a* and 114*b* operable to be received within pockets 122*a*,122*b*, respectively). As one skilled in the art will recognize upon reading the disclosure herein, the first and second insert support structures 118*a* and 118*b* can be provided about the drill pipe body 102 (as shown) using a variety of processes.

In one example, the first and second insert support structures 118*a* and 118*b* can be formed using a material forming or material build-up (i.e., additive) manufacturing process, such as by operating a plasma transfer arc tool (PTA tool), or other metal-forming or metal build-up tools. Generally, PTA tools are commonly used for hard metal coatings, and can be robotically controlled for high precision and repeatability. PTA welding provides a thermal process for applying wear and corrosion resistant layers on the drill pipe body 102. PTA hard-facing can provide a versatile method of depositing high-quality metallurgically fused deposits on drill pipes/casings. The PTA welding and/or hard-facing processes can be automated (e.g., with a robotic assembly and suitable programming), providing a high degree of reproducibility, while allowing precise metering of metallic powder feedstocks, resulting in lesser material quantity used compared to other welding processes. PTA processes permit precise control of weld parameters (e.g., such as powder feed rates, gas flow rates, amperage, voltage, heat input, and others), ensuring consistency across products. PTA processes produce alloy deposits that can be tougher and more corrosion resistant then counterparts laid down by gas tungsten arc welding (GTAVV) or Oxy-fuel welding (OFVV) processes. PTA processes also produce smooth deposits that significantly reduce required post weld machining. PTA process parameters can be adjusted to provide a variety of deposits in thicknesses ranging from 1.2 to 2.5 mm (0.05 to 0.10 in.) or higher. These can be deposited by a single pass at a rate of 1 kg/h up to 13 kg/h depending upon torch, powder and application.

In one example a PTA tool can be operated to form/weld the first insert support structures 118*a*, such that these are caused to extend radially around a portion of the first pipe section 110*a* and to be upset (i.e., raised) from the exterior surface of the first pipe section 110*a*. At this stage, this "formed" first insert support structure 118*a* is merely be a raised solid body base (not shown) of hard metal material (e.g., tungsten carbide) resulting from a number of weld-deposit passes along the drill pipe body 102 with the PTA tool. Once this "solid body" base is formed/welded to the first pipe section 110*a*, the cavity area 120*a* can be machined (e.g., by a CNC tool) to a desired thickness and surface area, thereby forming the shape and configuration of the insert support structures 118*a*, such as the shape and configuration illustrated in FIG. 3A (see also FIG. 4A). The particular shape and configuration of the insert support structures 118*a*,118*b* are not intended to be limiting in any way, as will be recognized by those skilled in the art. Indeed, the shape and configuration of the insert support structures 118*a*,118*b* can be any desired or needed for a particular application or drilling condition.

Upon forming the base and the cavity areas 120*a*,120*b*, the pockets 122*a*,122*b* can be machined into the base within the cavity areas 120*a*,120*b* of the first and second insert support structures 118*a*,118*b* to a particular depth and size. In one example, not to be limiting, the pockets 122*a*,122*b* can comprise a 1/16 to 1/8 of an inch depth formed and oriented about an axis normal to the respective different surfaces of the first and second drill pipe sections 110*a*,110*b* of the drill pipe body 102. The pockets 122*a*,122*b* can further comprise a cylindrical configuration having a given diameter (e.g., 5 mm), which size and configuration are operable to receive correspondingly sized and configured wear inserts 114*a*,114*b*, respectively. Of course, the size and shape/configuration, depth, orientation, number, etc. of the cavity areas 120*a*,120*b* and the pockets 122*a*,122*b*, as well as the corresponding wear inserts 114*a*,114*b*, can be any desired or needed for a given application. For example, in one aspect, the cavity areas 120*a*,120*b* can be formed and the wear inserts 114*a*,114*b* attached or mounted or otherwise secured directly to a surface of the cavity areas 120*a*,120*b* without the use of pockets.

Upon forming pockets 122*a* and 122*b*, the respective wear inserts 114*a* and 114*b* can be attached or mounted or otherwise secured within a respective pocket (e.g., see FIG. 38). In another aspect, multiple wear inserts can be disposed within a single larger pocket. Indeed, and although perhaps not discussed, any arrangement of pockets and wear inserts is contemplated herein. In any event, the same process described above can be repeated for any number of wear pads to be formed about the various sections of the drill pipe body 102.

In another example, the first and second insert support structures 118*a* and 118*b* can be formed separately or independently from the pipe body 102 and then later attached or otherwise coupled or joined (e.g., welded, brazed, etc.) to respective pipe sections 110*a* and 110*b*, such as with a PTA tool. For instance, the first and second insert support structures 118*a* and 118*b* can comprise a pre-formed structural component, such as one made of machined steel or aluminum, or grinded tungsten carbide. The pre-formed insert support structures 118*a*,118*b* can comprise a radius of curvature that matches the radius of curvature of the drill pipe body 102. Once the first and second insert support structures 118*a* and 118*b* are attached or joined or otherwise secured to the respective pipe sections 110*a* and 110*b* of the drill pipe body 102, wear inserts 114*a* and 114*b* can be attached or mounted to respective pockets 122*a* and 122*b* formed in the insert support structures 118*a*,118*b*, respectively.

Figure 3A:
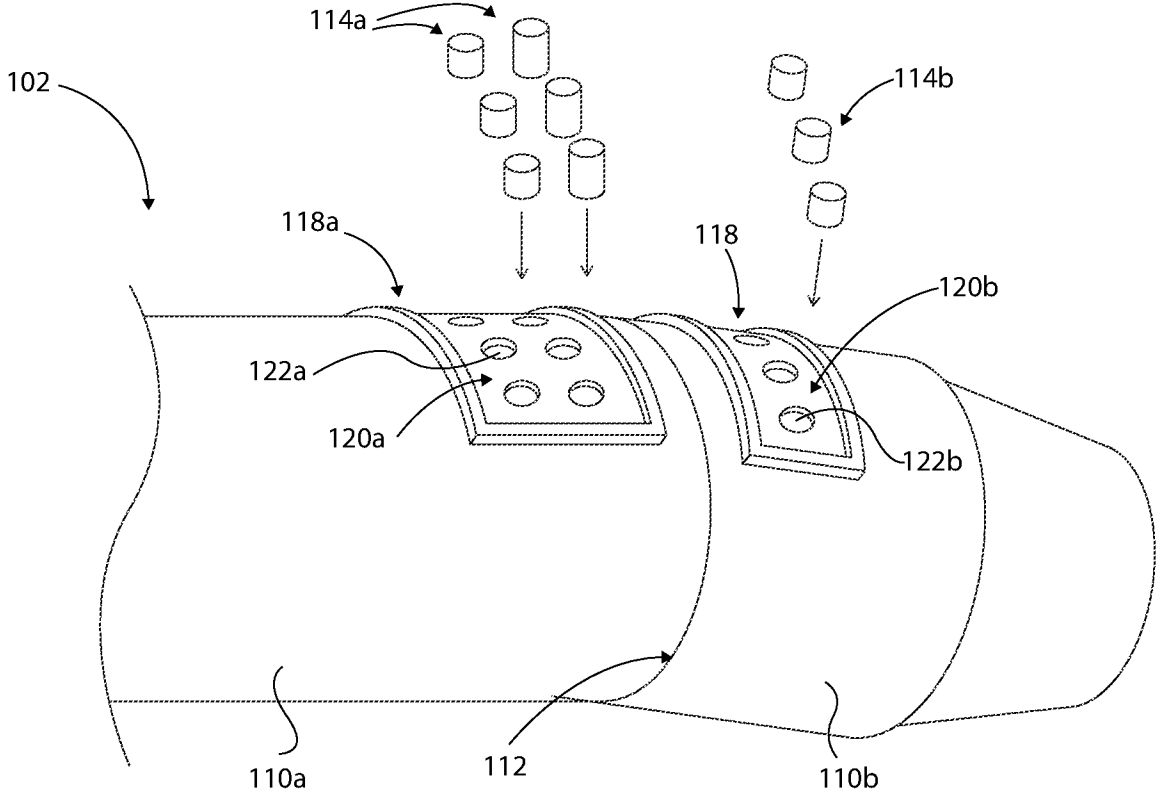
FIG. 3A illustrates a partial isometric view of the drill pipe body of FIG. 1, and the insert support structures and wear inserts at least partially making up the first and second wear pads.
Figure 3B:
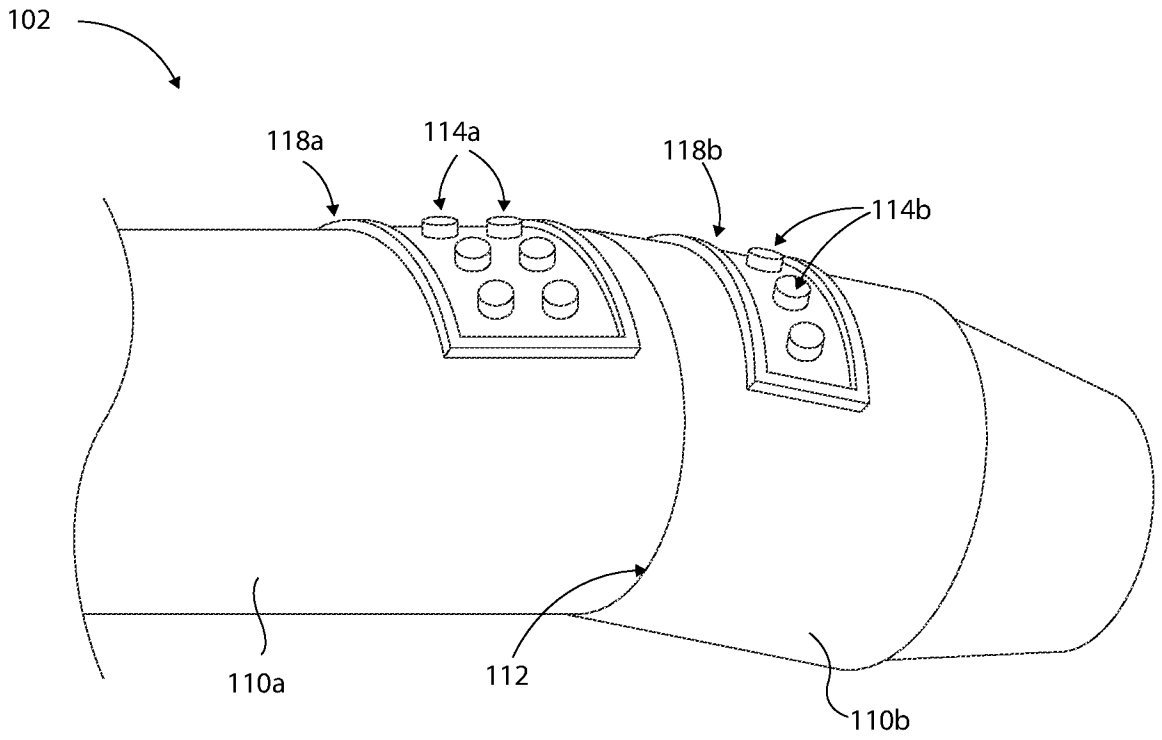
FIG. 3B illustrates a partial isometric view of the drill pipe body of FIG. 1, and the wear inserts as secured to the first and second insert support structures.

In yet another example, the first insert support structure 118*a* can be formed by modifying a commercially available and existing wear pad. For instance, some existing bent housing drill assemblies (or any other drill pipe or assembly) are sold having a wear pad upset (i.e., raised) from a surface of the drill pipe (but only formed above a bend portion). In such cases, the existing wear pad can be machined to form the cavity area 120*a* and pockets 122*a*, as shown in FIG. 3A. Then, the wear inserts 114*a* can be attached or mounted to pockets 122*a*, as discussed above, to provide an improved or enhanced wear pad over the existing one. Notably, such existing wear pads are only formed above the bend portion of a bent housing drilling assembly (i.e., opposite the side of the drill bit assembly relative to the bend portion), which can cause drastic wear issues to be introduced and present about or one the drill pipe section that is below the bend portion, in some cases damaging the assembly. As such, a second or secondary wear pad can be provided on the drill pipe body 102, as taught herein. Advantageously, the present disclosure provides dual-wear pads 104*a* and 104*b* separated about the bend portion 112 which prolongs the life of the drill pipe body 102 and improves performance of the overall drilling system, as further discussed herein. Thus, while the first wear pad 104*a* can be formed from an existing wear pad, the second wear pad 104 can be formed about or joined to the drill pipe body 102 in accordance with the teachings discussed herein.

Regardless of the various processes in which the insert support structures 118*a* and 118*b* can be formed about or joined to the drill pipe body 102, the wear inserts 114*a* and 114*b* can then be mounted or attached to the insert support structures 118*a*,118*b*, such as within the pockets 122*a* and 122*b*. The wear inserts can be mounted or otherwise secured using any known process. In one example, the wear inserts 114*a*,114*b* can be secured to the insert support structures 118*a*,118*b* using a brazing or welding process. For instance, a PTA tool can be used to weld the wear inserts 114*a* and 114*b* into the pockets 122*a* and 122*b* to secure the wear inserts 114*a* and 114*b* in place such that they are able to withstand the various directional forces and loads placed upon them during a drilling operation. The securing of the wear inserts 114*a*,114*b* should be sufficient such that they do not become prematurely dislodged during the downhole drilling operation. Alternatively, a brazing process can be used to braze each wear insert 114*a* and 114*b* into respective pockets 122*a* and 122*b*. In any event, the (shallow) pockets 122*a* and 122*b* can be arranged in an array (FIG. 5) to laterally support and spatially position the wear inserts 114*a* and 114*b* in their respective positions. The process and configurations described provide an advantage over existing systems by securing the wear inserts 114*a* and 114*b* to the drill pipe body 102 via the insert support structures 118*a* and 118*b*, thus minimizing the chance that the wear inserts will become dislodged during drilling.

Figures 3C, 3D:
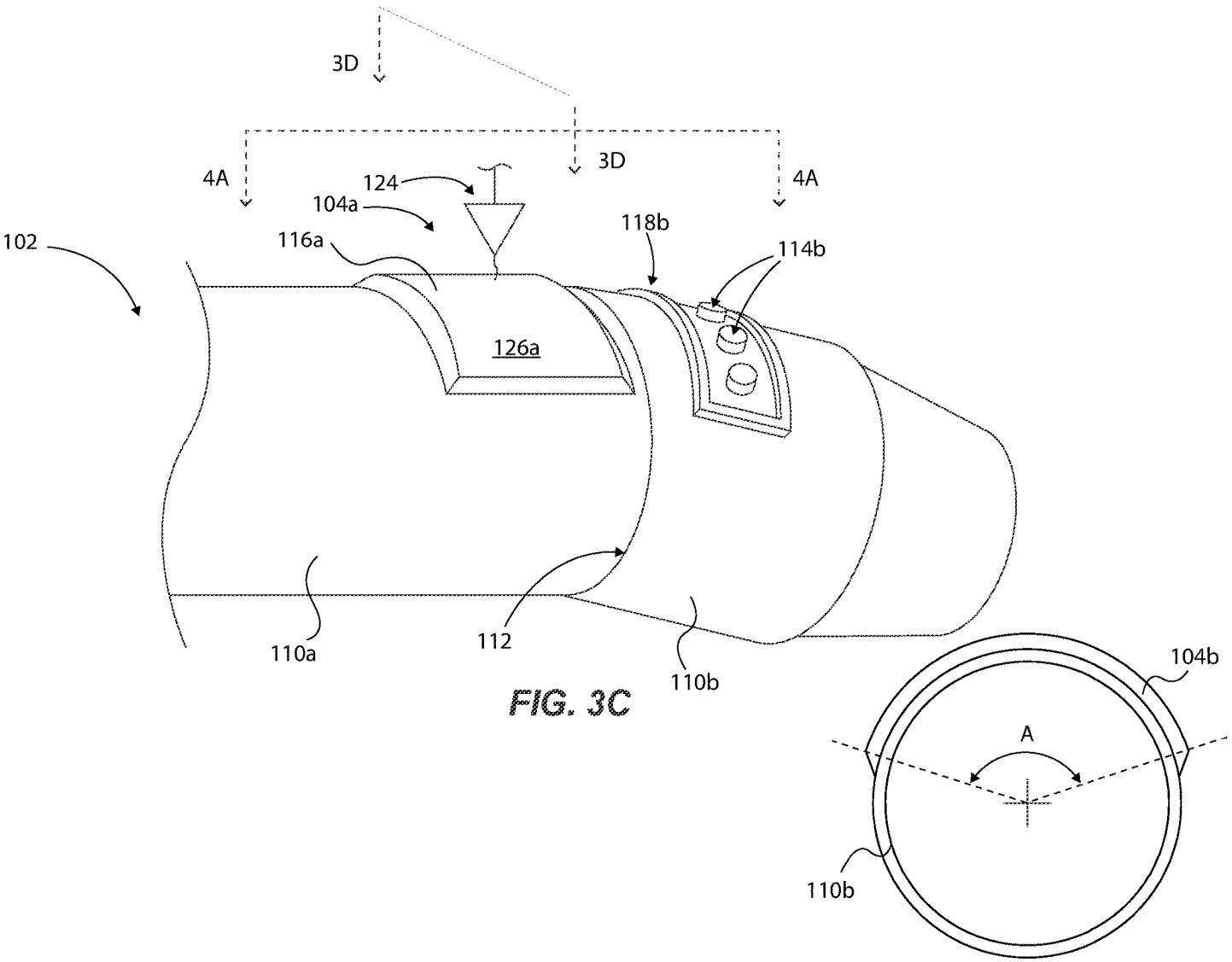
FIG. 3C illustrates a partial isometric view of the drill pipe body of FIG. 1, with the wear material encasing the wear inserts secured in the first insert support structure, to form the first wear pad.
FIG. 3D illustrates a cross-sectional front view of the first pipe section of the drill pipe body of FIG. 1, taken just prior to the bend portion along lines 3D-3D of FIG. 3C, and FIG. 3D further illustrates the location and radial size of the first wear pad relative to the overall diameter of the drill pipe body.
Figure 4A:
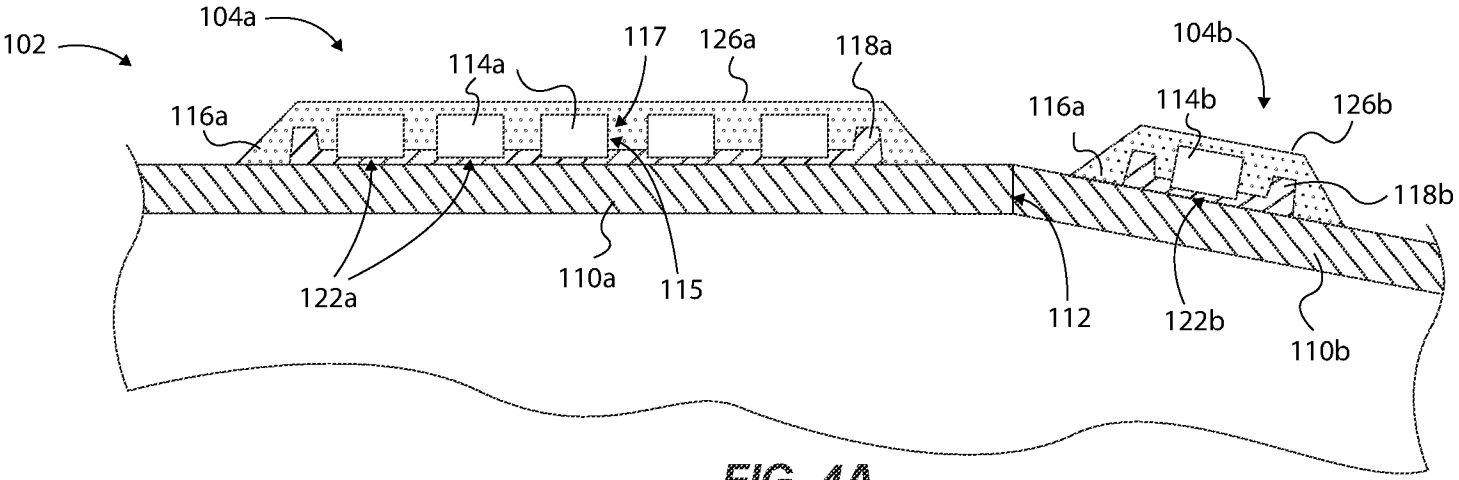
FIGS. 4A and 4B illustrate a cross-sectional side plan schematic view of a portion of the drill pipe body and dual-wear pads of FIG. 1, and taken along lines 4A-4A of FIG. 3C.

Upon mounting or otherwise securing the wear inserts 114*a* and 114*b* to the respective insert support structures 118*a* and 118*b* within the pockets 122*a* and 122*b*, the wear pad material 116*a* and 116*b* can be deposited over the wear inserts 114*a* and 114*b*, respectively, to form the wear pads 104*a* and 104*b*, such that they are at least partially, or completely, encased by and within the wear pad material 116*a* and 116*b*, respectively (see also FIG. 4A). Note that for purposes of illustration, FIG. 3C only illustrates the wear pad 104*a* as comprising the wear pad material 116*a*. Wear pad 104*b* illustrates the wear inserts 114*b* as secured within the insert support structure 118*b* just prior to and in preparation for receiving wear pad material.

In one example, the wear pad material 116*a* and 116*b* can be configured to be flowed (i.e., caused, such as heated, to be applied in one state, such as a liquid, capable of transitioning to a solid state, such as by cooling) around and over the respective insert support structures 118*a* and 118*b* and the wear inserts 114*a* and 114*b*, such that the wear inserts 114*a* and 114*b* are at least partially, and in most cases completely, surrounded or encased by the flowed wear pad material 116*a* and 116*b*. In a similar manner, the insert support structures 118*a* and 118*b* are also encased and covered by the wear pad material 116*a* and 116*b*. In one aspect, this can be achieved by operating a programmable PTA tool 124 configured to flow wear pad material (e.g., see wear pad material 116*a* of FIG. 30) over and around the wear inserts 114*a* and 114*b* to at least partially encase or cover (or completely encase or cover) the wear inserts 114*a* and 114*b* and the first and second insert support structures 118*a* and 118*b*. This process and the components and materials used can define and makeup a wear pad, such as first wear pad 104*a* and the second wear pad 104*b*. The first and second wear pads 104*a* and 104*b* can comprise a wear pad surface (e.g., see the wear pad surface 126*a* of the first wear pad 104*a* in FIG. 3C (the second wear pad 104*b* also comprising a similar wear pad surface, although not shown in FIG. 3C). Indeed, this same or a similar process can be carried out in order to also encase or cover the wear inserts 114*b* and the second insert support structure 118*b*, thereby forming the second wear pad 104*b* having a wear pad surface 126*b* (e.g., see FIG. 4A).

The amount of wear material added to the drill pipe body 102 to encase the wear pad inserts 114*a* and 114*b* and the first and second insert support structures 118*a* and 118*b* can vary depending upon need or desire or the particular application or drilling conditions involved. Similarly, the size and configuration of the wear inserts can vary. It will be apparent to those skilled in the art that the size, configuration, material, etc. of the wear inserts, the insert support structures and the wear material, these all making up the wear pad, can vary as needed or desired to form suitable wear pads about the drill pipe body 102 in accordance with the technology disclosed herein. In addition, the first wear pad 104*a* can be the same as or different from the second wear pad 104*b* in terms of size (e.g., height, width, length), orientation, configuration, material makeup, density of wear inserts, type of wear inserts or wear pad material, number of wear inserts, etc.

In an alternative example, an insert support structure may not be employed to form the wear pad(s). Specifically, the wear inserts discussed herein can be directly welded or brazed to an exterior surface (or pocket) of the drill pipe body 102 itself, and then encased as discussed.

Once the wear inserts 114*a* and 114*b* are encased within the wear pad material 116*a* and 116*b*, the wear pad surfaces 126*a* and 126*b* can be further processed and finished. In one example, the wear pad surfaces 126*a* and 126*b* or other portions of the wear pads 104*a* and 104*b* can be surface grinded using a grinding or other similar tool to define a desired diameter and/or depth of each of the wear pads 104*a* and 104*b*. For example, with a pipe body having an exterior diameter of 5 inches, the wear pads 104*a* and 104*b* can be sized, such that the overall diameter of the pipe body and wear pad assembly is between 5¼ inches and 5¾ inches. Of course, this is not intended to be limiting in any way, as those skilled in the art will recognize that the wear pads 104*a* and 104*b*, and thus the overall assembly, can comprise any suitable size.

Once encased and suitably finished to form the first and second wear pads 104*a* and 104*b*, the wear inserts 114*a* and 114*b* act to reinforce the wear pad material 116*a* and 116*b* during drilling operations. The wear inserts 114*a* and 114*b* can also act as a secondary wear component, as further discussed below.

In one example, the wear inserts 114*a* and 114*b* can be comprised of a tungsten carbide material impregnated with industrial diamonds, and configured to comprise a cylindrical shaped body having a diameter of at least 5 mm and a thickness (i.e., height or depth) of at least 2 mm. Of course, this is only an example, and other sizes are possible and contemplated herein (e.g., see FIGS. 5-7). Plasma Technology Automation & Materials offer products known as PT-MAT that comprise cylindrical tiles (disks) of tungsten carbide impregnated with industrial diamonds. The wear inserts 114*a* and 114*b* can comprise such tiles or other similarly formed inserts. In one aspect, the tungsten carbide wear inserts 114*a* and 114*b* can be impregnated with 40-50 mesh diamond with either 25 percent or 40 percent diamond volume. The industrial diamonds can be premium grade (SDB-1125 or similar) to allow for better weld or braze attachment with the wear pad material. Some examples of wear inserts that are offered under PT-MAT products are cylindrical wear inserts having 13 mm diameter and 3-5 mm thickness, with varying diamond concentrations ranging from 25-40 percent. Of course, other examples, sizes and configurations are contemplated. In another example, the wear inserts 114*a* and 114*b* can be rectangular in shape (e.g., those having 13×5×3-5 mm dimensions) with varying diamond concentrations from 25-40 percent. The diamond size can average 40-50 mesh (or 300-425 μm), and the matrix can be WC/Ni (85/15).

The primary and secondary wear inserts 114*a* and 114*b* can comprise a known hardness, such as a hardness measured using Mohs, Rockwell, Vickers, Shore, and/or Brinnell scales]. In one example, the hardness of diamond impregnated wear inserts 114*a* and 114*b* can be between approximately 9 and 10 (using the Moh's hardness scale) (i.e., a first hardness), and the tungsten carbide wear pad material 116*a* and 116*b* discussed herein can have a hardness between approximately and 8.5 and 9 (using the Moh's Hardness scale)(i.e., a second harness). In a specific example, the hardness of the diamond impregnated wear inserts 114*a* and 114*b* discussed herein can be approximately 10, and the hardness of the tungsten carbide wear pad material 116*a* and 116*b* discussed herein can be approximately 9. No matter the material makeup of the wear inserts 114*a* and 114*b* or the wear pad material 116*a* and 116*b*, the hardness of the material or material composition of the wear inserts 114*a* and 114*b* is intended to be greater than the hardness of the wear pad material 116*a* and 116*b*, thereby providing primary and secondary wear components with primary and secondary wear capabilities that function to prolong the life of the wear pad(s) and the drill pipe body, as discussed herein, wherein the secondary wear capabilities of the wear inserts 114*a* and 114*b* reinforce the primary wear capabilities of the wear pad material.

Due to their strategically configured material makeup, the wear inserts 114*a* and 114*b* can be joined or otherwise coupled or secured (e.g., welded, brazed, etc.) to the insert support structures 118*a* and 118*b*, and then encased by the PTA tool 124, for instance. As discussed above, the wear inserts 114*a* and 114*b*, in one example, can be selected from particular construction of tungsten carbide materials impregnated with a particular diamond concentration. In this case, the wear inserts 114*a* and 114*b* can be configured to receive a weld (i.e., one configured to molecularly bond with a weld material, such as tungsten carbide), thus more permanently securing the wear inserts 114*a* and 114*b* to the drill pipe body 102 over prior art designs. Indeed, being able to secure the wear inserts 114*a* and 114*b* in place via a weld provides significant advantages over prior art wear inserts. For instance, unlike the wear inserts discussed herein, many existing wear inserts used in downhole drilling applications include inserts known as "PCD inserts" (polycrystalline diamond), which are incapable of being welded because their metallurgical properties prohibit weld attachments/bonding. Thus, such PCD inserts are typically press-fit into drill bit housings, wear pad surfaces, etc., which makes them prone to dislodging from the press-fit interface, which can lead to slower drilling operations, unwanted downtime, more frequent repairs, etc. With the present technology, and particularly as the wear inserts are welded in place, the wear inserts 114*a* and 114*b* are significantly less prone to being prematurely or inadvertently dislodged and unsecured from the drill pipe body 102.

FIG. 3D illustrates a front cross-sectional view (schematic) of the drill pipe body 102 of FIG. 3C taken just prior to the bend portion 112. As shown, the first wear pad 104*a* can be located about the surface of the drill pipe body 102, and sized and configured to extend radially around the drill pipe body 102 a given number of degrees. In the example shown, the first wear pad 104*a* can be configured to radially extend around or about the exterior circumference of the drill pipe body 102 approximately 140 degrees, as represented by arrow A and the dashed lines. However, this is not intended to be limiting in any way. Indeed, those skilled in the art will recognize that the wear pads 104*a* and 104*b* can be configured to radially extend any number of degrees around or about the drill pipe body 102. Stated differently, and in one example, the radial size or length of each wear pad 104*a* and 104*b* can be approximately 4 to 6 inches as measured around the exterior circumference of a 5 inch diameter drill pipe body 102 (or in other words, the length can be between approximately 25 and 40 percent of the circumference of the drill pipe body 102). However, the first wear pad 104*a* can be sized and configured as needed or desired to provide optimal performance of the wear pad (e.g., during rotary drilling), namely to provide protection to the drill pipe body 102, thus prolonging its life. Although not specifically shown in FIG. 3D, it will be apparent to those skilled in the art that the second wear pad can be sized, configured, positioned, etc. in a similar manner, or different as needed or desired.

Figure 4B:
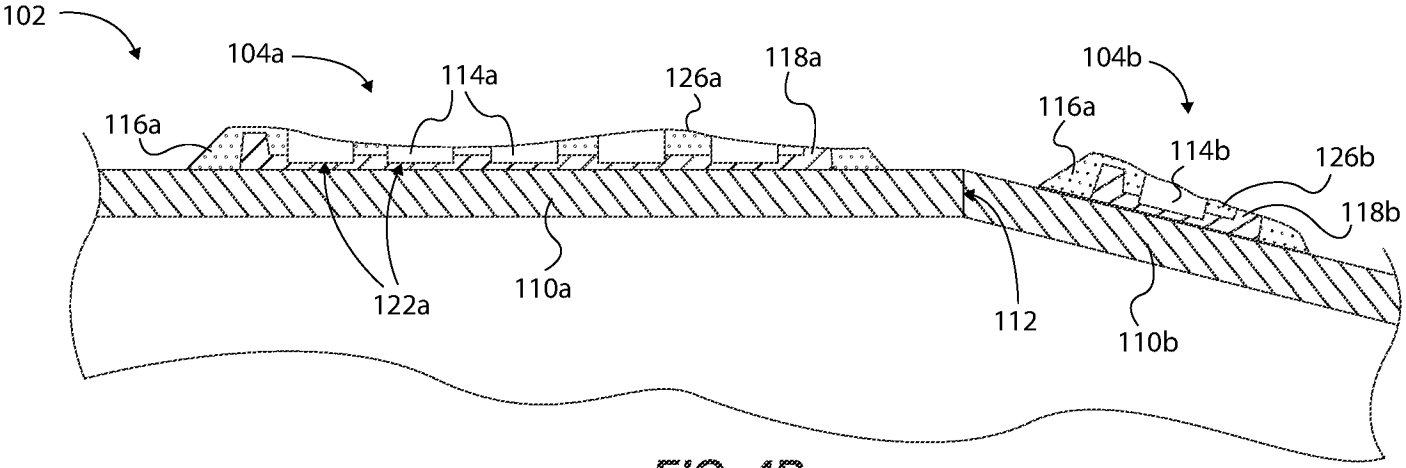

FIGS. 4A and 4B illustrate partial cross-sectional views of an upper section of the drill pipe body 102, taken along a longitudinal axis of the drill pipe body 102 (see FIG. 3C). Specifically, FIG. 4A illustrates the first and second wear pads 104*a* and 104*b*, as fully formed and situated about the drill pipe body 102, and the respective components that these are comprised of. FIG. 4B illustrates the first and second wear pads 104*a* and 104*b* as being partially worn, such as after undergoing one or more drilling operations (note that the wear pad material 116*b* is shown in FIGS. 4A and 4B, but omitted in FIG. 3C for purposes of illustration). For example, the wear pad material 116*a* of the first wear pad 104*a* can provide a primary wear component, and the wear inserts 114*a* can provide a secondary wear component. During a drilling operation, the primary wear component (e.g., the wear pad material 116*a*) can be caused to first wear as it provides the outermost surface of the first wear pad 104*a*. Depending upon the particular configuration of the first wear pad 104*a* and the drilling conditions, once a certain amount of the wear pad material 116*a* has been removed due to wear (e.g., once the wear material has been reduced in thickness, such as 1-2 mms), the secondary wear component (e.g., the wear inserts 114*a*) are caused to be exposed and to begin to wear along with continued wear of the surrounding wear pad material 116*a*. The same can be said for the second wear pad 104*b*. The wearing of the first and second wear pads 104*a* and 104*b* are graphically illustrated in FIG. 4B, which shows each of the first and second wear pads 104*a* and 104*b* "worn down" to some degree. Indeed, the location of the respective wear surfaces 126*a* and 126*b* shown in FIG. 4B illustrate an example degree of wear that each of the first and second wear pads 104*a* and 104*b* can undergo as a result of being functional within a drilling operation. FIG. 4B further illustrates that both the wear pad material 116*a* and 116*b*, and the exposed one or more of the encased wear inserts 114*a* and 114*b* of the first and second wear pads 104*a* and 104*b*, can collectively wear together once the wear insert(s) are indeed exposed. As these are configured to comprise different hardness properties, the first and second wear pads 104*a* and 104*b* are each provided with primary and secondary wear components, which can help to slow the rate at which the first and second wear pads wear, thus increasing the life of the wear pads and the drill pipe body due to the fact that the wear resistance is improved or increased as compared to existing wear pads that do not comprise a secondary wear component, namely one as discussed herein.

With continued reference to FIGS. 1-7, the insert support structures 118*a* and 118*b* can be configured in a variety of ways. For example, the insert support structures 118*a* and 118*b* can comprise pockets or recesses having any suitable size and shape to fit and support wear inserts having a corresponding size and shape. In one example (e.g., see FIGS. 3A and 5), the pockets 122*a* and 122*b* can comprise cylindrical bores machined/formed to a given depth (e.g., 1/16 of an inch), thus being sized and configured to receive corresponding cylindrical wear inserts, such as wear inserts 114*a* and 114*b*. For instance, a lower end portion 115 (see FIG. 4A, only one end portion being labeled) of one of the wear inserts 114*a* can be received into a pocket 122*a* of the insert support structure 118*a*, such that an upper portion 117 of the wear insert 114*a* extends above the pocket 122*a* (as illustrated in FIG. 4A). This can be the case with each of the wear inserts 114*a* and 114*b* as they are secured within the first and second insert support structures 118*a* and 118*b*, respectively. In this arrangement, the upper portion 117 (i.e., the portion not received within the pockets of the insert support structures 118*a* and 118*b*) of each of the wear inserts 114*a* and 114*b* can be entirely surrounded and encased by the wear pad material 116*a* and 116*b*, respectively.

Although the above discussion has described the wear inserts as being completely encased within or by the wear pad material, alternatively, in some examples, an upper portion of one or more wear inserts can be caused to be exposed or to extend beyond/above the wear pad material, such that at least a portion of the wear inserts are exposed in the final assembly of the wear pad. In this arrangement, the wear inserts may be caused to comprise the outermost surface of the wear pad that initially wears during a drilling operation.

In any event, the term "encase" is broadly used in the present disclosure to mean that the wear pad material covers or surrounds at least a portion of the wear inserts, even if just a small portion of the wear insert. In some examples, the wear pad material and the wear inserts can be configured, such that a bond or weld interface is formed between the wear insert and the wear pad material. The term encase is further broadly used to mean that the wear pad material can cover or surround at least some of the surface area of the wear inserts.

The term "insert" is also broadly used in the present disclosure to mean any wear-resistant component or device that is inserted or encased by or within, supported by or coupled to or integrated with the wear pad material to form a wear pad, thus providing the wear pad with primary and secondary wear components. The wear inserts can include material selected from one or more or a combination of materials. For example, and not intending to be limiting in any way, the wear inserts can comprise diamond, tungsten, carbide, etc. In some examples, the wear insert can be large enough in size relative to the overall wear pad to provide some degree of structural support or reinforcement, along with providing wear resistance benefits to the wear pad. For example, a particular wear insert can comprise a size that is approximately 2-5 $mm^3$ in volume regardless of its particular shape. Moreover, wear inserts can be of various shapes, thicknesses, sizes, etc., and manufactured out of various material compositions based on environmental requirements, such as the type of rock and/or soil being drilled through.

In one example, as pertaining to a five inch diameter drill pipe, the first wear pad 104*a* can comprise an overall lateral or radial length of at least five inches (e.g., see FIG. 4A), and an upper surface (e.g., 126*a*) length of at least four inches. This overall lateral length represents approximately a 30 percent increase in length as compared to existing wear pads on five inch drill pipes. An overall lateral length of the second wear pad 104*b* can be at least two inches, and an upper surface (e.g., 126*b*) length can be at least one inch. The wear pads 104*a* and 104*b* can be separated from one another a given distance along a length of the drill pipe body, and particularly about a bend portion in the drill pipe, and such separation distances may vary as needed or desired. For example, the wear inserts 114*a* and 114*b* can be separated from one another by approximately ½ to ⅝ of an inch, depending on the drilling application.

Figure 5:
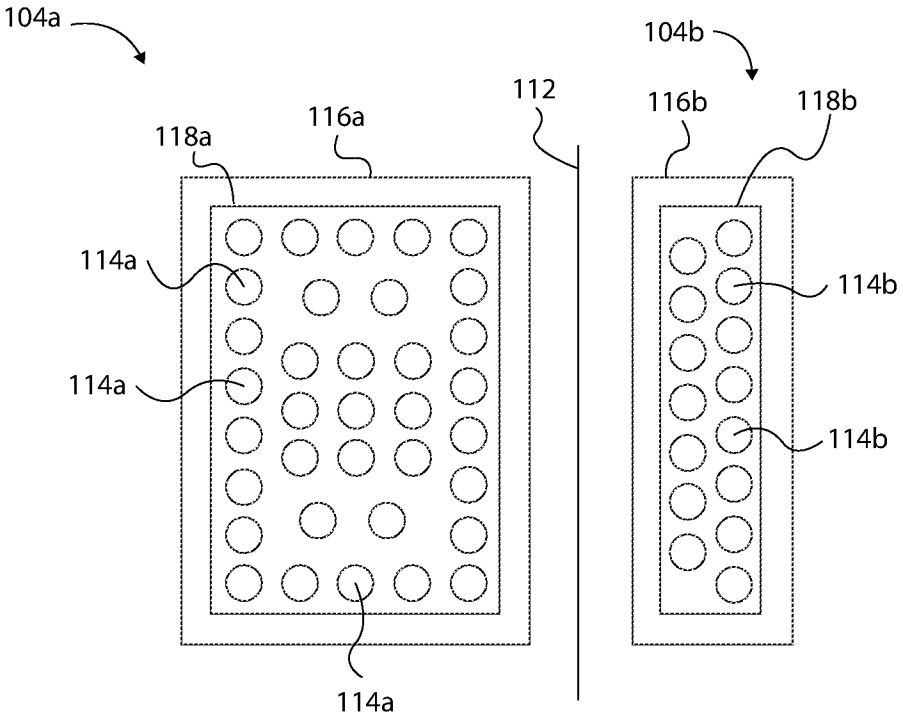
FIG. 5 illustrates a schematic drawing of a wear pad arrangement in accordance with an example of the present disclosure.
Figure 7:
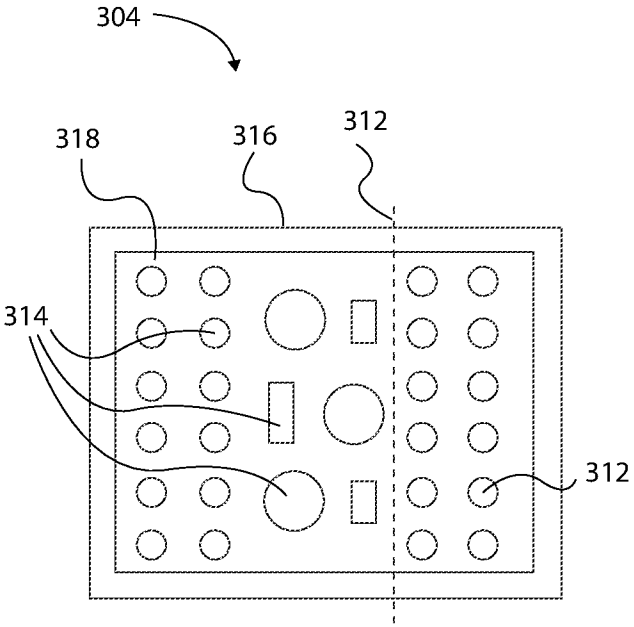
FIG. 7 illustrates a schematic drawing of a wear pad arrangement in accordance with an example of the present disclosure.
Figure 6:
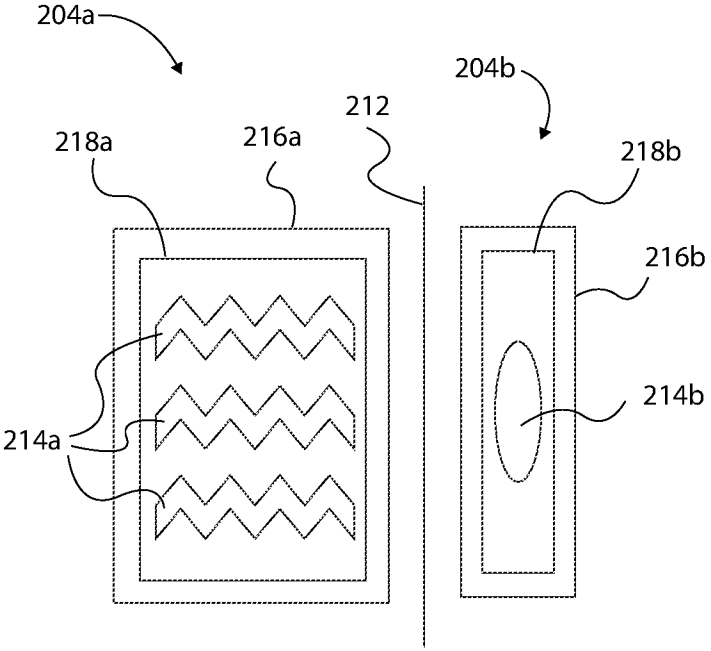
FIG. 6 illustrates a schematic drawing of a wear pad arrangement in accordance with an example of the present disclosure.

FIGS. 5-7 schematically illustrate various examples of wear pad configurations formed about a bend portion. In the example shown in FIG. 5, the first wear pad 104*a* comprises a plurality of wear inserts 114*a* arranged in an array about the insert support structure 118*a*, and the second wear pad 104*b* comprises a plurality of wear inserts 114*b* arranged in an array about the insert support structure 118*b*. Note that FIG. 5 shows one example of an array configuration of the wear inserts 114*a* and 114*b* of FIGS. 1-4B. As will be recognized by those skilled in the art, the wear pads 104*a* and 104*b* can comprise any number of wear inserts arranged in any one of a variety of positions or locations. In one example, each wear pad 104*a* and 104*b* can comprise at least 10 wear inserts, and in some examples at least 20 wear inserts, and in other examples at least 40 wear inserts, and in other examples less than 100 wear inserts. Furthermore, the wear pad 104*a* and 104*b* can comprise different numbers of wear inserts and different positional layouts. For instance, the positioning and spacing of the wear inserts relative to each other can be designed to accommodate for larger protective surfaces (e.g., the coverage around a drill pipe), and for an increase or decrease in reinforcement requirements of a particular wear pad.

In another example, FIG. 6 shows a first wear pad 204*a* having a pair of elongated wear inserts 214*a* arranged side by side relative to the insert support structure 218*a*, and a second wear pad 204*b* having a single wear insert 214*b* positioned centrally about the insert support structure 218*b*. FIG. 6 exemplifies that only one insert (214*b*) can be utilized within a particular wear pad, and that the insert(s) can take a variety of shapes and forms (e.g., 214*a*), these being designed for a pre-determined purpose. In some cases, a plurality of smaller inserts may be desirable or needed, such as those illustrated in FIGS. 2-5, as they can be are more easily arranged radially along the drill pipe body. Such wear pads 204*a* and 204*b* of FIG. 6 can be formed and configured in a similar manner as those discussed above regarding the wear pads illustrated in FIGS. 1-4B.

In yet another example, FIG. 7 shows a single wear pad 304 that extends over a bend portion 312 of a bent housing drill assembly. FIG. 7 further shows that a plurality of wear inserts 314 can take a variety of shapes and sizes (and patterns) along an insert support structure 318 of the wear pad 304. Such wear pad 304 of FIG. 7 can be formed and configured in a similar manner as those discussed above regarding the wear pads of FIGS. 1-4B.

It will be appreciated by those skilled in the art that the particular arrangement and size of the wear inserts of the present disclosure can depend on the particular drilling application. For instance, for more severe directional drilling, more wear inserts may be provided by a wear pad closer toward the dill bit since that area may wear more quickly than other areas. Also, wear inserts that are larger in diameter or taller (height) than those exemplified above may be used in certain portions of a wear pad, such as for areas of the drill pipe that are more prone to wearing at a faster rate than other areas or portions. An example of wear inserts having differing heights is illustrated in FIG. 3A.

Figure 8:
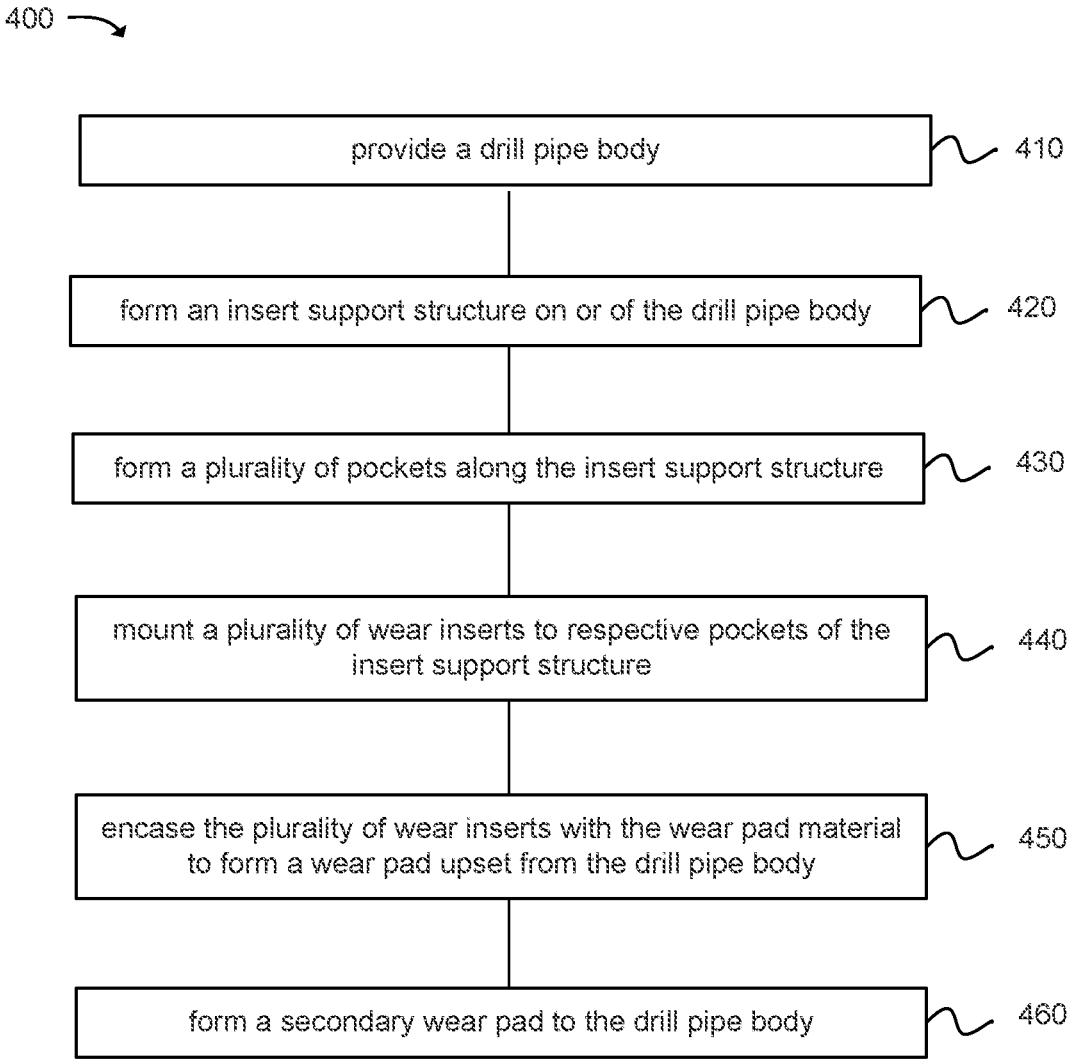
FIG. 8 is a block diagram illustrating a method of forming wear pad(s) in accordance with an example of the present disclosure.

With reference to FIG. 8 and continued reference to FIGS. 1-4B, FIG. 8 is a flow diagram illustrating an example method 400 of forming one or more wear pads on a drill pipe to resist wear during downhole drilling in accordance with an example of the present disclosure, as further supported by the examples discussed above. At operation 410, the method comprises obtaining a drill pipe body (e.g., drill pipe body 102), which can include forming a drill pipe body, purchasing a drill pipe body, etc. At operation 420, the method comprises providing an insert support structure (e.g., see insert support structures 118*a*, 118*b*) on or about the drill pipe body. As discussed above, the insert support structure can comprise a pre-formed structure that is subsequently attached or otherwise secured to the drill pipe body, the insert support structure can be fabricated, such as built up or formed onto the drill pipe body (e.g., by using a PTA tool), or it can be formed by modifying (e.g., machining down) an existing wear pad to achieve a desired insert support structure. At operation 430, the method comprises providing a plurality of pockets (e.g., 122*a*, 122*b*) within the insert support structure, such as described regarding FIG. 3A. The pockets can also be shaped and sized to receive any suitable wear insert, such as those shown in FIGS. 5-7. The pockets can be pre-formed as existing within a pre-formed insert support structure, or they can be formed during the fabrication, manufacture or formation of an insert support structure.

At operation 440, the method comprises mounting a plurality of wear inserts (e.g., 114*a*, 214*a*, 314) to the insert support structure. This can be done in a variety of ways. This can further comprise inserting the wear inserts into the respective pockets of the insert support structure, and securing these in place, such as described above regarding FIGS. 3A and 3B.

At operation 450, the method comprises encasing the plurality of wear inserts with the wear pad material (e.g., 116*a*) to form a wear pad (e.g., 104*a*) upset from the drill pipe body, such as described above regarding FIGS. 30-4B.

At operation 460, the method comprises forming a second wear pad (e.g., 104*b*) on a second pipe section (e.g., 110*b*) of the drill pipe body. As discussed above, the wear pad (e.g., 104*a*) can be attached to a first pipe section (e.g., 110*a*), whereby the first and second pipe sections are separated by a bend portion (e.g., 112). This provides a second wear pad below the bend portion, which has the advantages discussed herein.

Operations 420-450 can be repeated (or they can occur concurrently while forming wear pad 104*a*) to form the second wear pad (e.g., 104*b*). Thus, the second wear pad can also include a plurality of wear inserts (e.g., 114*b*), an insert support structure, and a wear pad material (e.g., 116*b*) that at least partially encases the plurality of wear inserts, as further discussed above.

Once the wear pads discussed herein are worn down to an undesirable level such that they are no longer suitably functional for their intended purpose during a drilling operation, the method of FIG. 8 can be performed again on the drill pipe body to form replacement wear pad(s).

It is to be understood that the examples of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular examples only and is not intended to be limiting.

Reference throughout this specification to "one example" or "an example" means that a particular feature, structure, or characteristic described in connection with the example is included in at least one example of the present invention. Thus, appearances of the phrases "in one example" or "in an example" in various places throughout this specification are not necessarily all referring to the same example.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various examples of the present invention may be referred to herein along with alternatives for the various components thereof. It is understood that such examples, and alternatives are not to be construed as de facto equivalents of one another, but are to be considered as separate and autonomous representations of the present technology.

Furthermore, the described features, structures, or characteristics may be combined in any suitable manner in one or more examples. In the description, numerous specific details are provided, such as examples of lengths, widths, shapes, etc., to provide a thorough understanding of examples of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A drill pipe having a wear pad for resisting wear during downhole drilling, the drill pipe comprising:

a drill pipe body; and a wear pad upset from the drill pipe body, the wear pad comprising a plurality of wear inserts secured within the wear pad and a wear pad material that at least partially encases the plurality of wear inserts, wherein the plurality of wear inserts comprises a hardness greater than a hardness of the wear pad material, wherein the drill pipe body comprises a bend portion that defines and separates a first pipe section and a second pipe section, the drill pipe further comprising a second wear pad attached to the second pipe section, wherein the wear pad is attached to the first pipe section.

2. The drill pipe of claim 1, wherein the second wear pad comprises a plurality of wear inserts and a wear pad material that at least partially encases the plurality of wear inserts, wherein the plurality of wear inserts comprises a hardness greater than a hardness of the wear pad material.

3. The drill pipe of claim 1, wherein the wear pad and the second wear pad are each formed at least 140 degrees radially around an exterior surface of the drill pipe body.

4. The drill pipe of claim 1, wherein the plurality of wear inserts are arranged in an array.

5. The drill pipe of claim 1, further comprising an insert support structure positioned about the drill pipe body, the insert support structure being operable to receive and secure the plurality of wear inserts, the insert support structure being at least partially encased in the wear pad material.

6. The drill pipe of claim 5, wherein the insert support structure comprises a plurality of pockets, wherein one or more wear inserts of the plurality of wear inserts are received within a respective pocket.

7. The drill pipe of claim 5, wherein the wear pad material completely encases the plurality of wear inserts, such that a top of the wear inserts and the insert support structure is covered.

8. The drill pipe of claim 1, wherein the wear pad material comprises a hard metal comprising tungsten carbide material deposited onto the drill pipe body.

9. The drill pipe of claim 1, wherein the wear pad material is deposited onto the drill pipe body via a plasma transfer arc welding process.

10. The drill pipe of claim 1, wherein the plurality of wear inserts comprises tungsten carbide material impregnated with industrial diamonds.

11. The drill pipe of claim 1, wherein the plurality of wear inserts comprises wear inserts of differing size.

12. The drill pipe of claim 1, wherein the wear pad is formed at least 140 degrees radially around an exterior surface of the drill pipe body.

13. The drill pipe of claim 1, wherein the drill pipe body comprises a bend portion that defines and separates a first drill pipe section and a second drill pipe section, wherein the wear pad is attached to the first and second drill pipe sections and extends over the bend portion.

14. The drill pipe of claim 1, wherein the drill pipe comprises a fixed bent housing for a mud motor, the fixed bent housing comprising a second wear pad formed adjacent the wear pad, the wear pad and the second wear pad being separated from one another about a bend portion of the fixed bent housing.

15. The drill pipe of claim 1, wherein the wear pad further comprises:

an insert support structure having a recess formed therein; and a plurality of pockets formed in the recess of the insert support structure, wherein a plurality of wear inserts are seated within a respective pocket and mounted to the insert support structure, wherein the wear pad material encases the plurality of wear inserts, such that the wear pad material provides a primary wear surface of the wear pad, and such that the plurality of wear inserts provide a secondary wear surface.

16. A bent housing drill assembly having dual-wear pads to resist wear during downhole drilling, the bent house drill assembly comprising:

a drill pipe body having a first pipe section and a second pipe section separated by a bend portion;

a first wear pad upset from the first pipe section; and a second wear pad upset from the second pipe section, wherein at least one of the wear pads comprises a plurality of wear inserts secured within the at least one of the wear pads and a wear pad material that at least partially encases the plurality of wear inserts.

17. The bent housing drill assembly of claim 16, wherein the first and second wear pads each comprise the plurality of wear inserts and the wear pad material that encases the plurality of wear inserts.

18. The bent housing drill assembly of claim 16, wherein the first and second wear pads each extend at least 140 degrees radially around an exterior surface of the drill pipe body.

19. The bent housing drill assembly of claim 16, wherein the first and second wear pads each comprise an insert support structure that supports the plurality of wear inserts.

20. The bent housing drill assembly of claim 19, wherein the insert support structure comprises a plurality of pockets, wherein each of the plurality of wear inserts are attached to a respective pocket.

21. The bent housing drill assembly of claim 16, wherein the wear pad material comprises a tungsten carbide material deposited via a plasma transfer arc welding tool to form wear pad exterior surfaces of each of the first and second wear pads.

22. The bent housing drill assembly of claim 16, wherein the plurality of wear inserts have a hardness harder than a hardness of the wear pad material.

23. A method of forming a wear pad on a drill pipe to resist wear during downhole drilling, the method comprising:

providing a drill pipe body;

securing a plurality of wear inserts to the drill pipe body;

encasing the plurality of wear inserts with a wear pad material to form a wear pad upset from the drill pipe body; and forming an insert support structure of the drill pipe body, wherein the plurality of wear inserts is mounted to the insert support structure, and wherein the wear pad material encases the plurality of wear inserts and the insert support structure.

24. The method of claim 23, further comprising mounting the plurality of wear inserts in an array to the insert support structure, and encasing the plurality of wear inserts with the wear pad material.

25. The method of claim 24, further comprising forming a plurality of pockets along the insert support structure, wherein each of the plurality of wear inserts are attached to a respective pocket.

26. The method of claim 24, further comprising operating a plasma transfer arc welding tool to deposit the wear pad material, wherein the wear pad material comprises a hard metal that encases the plurality of wear inserts to form a primary wear component, wherein the plurality of wear inserts provide a secondary wear component.

27. The method of claim 26, further comprising programming a robotic assembly to operate the plasma transfer arc welding tool.

28. The method of claim 23, further comprising forming a second wear pad on a first pipe section of the drill pipe body, wherein the wear pad is attached to a second pipe section, wherein the first and second pipe sections are separated by a bend portion.

29. The method of claim 28, wherein the secondary wear pad comprises a second plurality of wear inserts and a second wear pad material that at least partially encases the second plurality of wear inserts.

30. A drill pipe having a wear pad for resisting wear during downhole drilling, the drill pipe comprising:

a drill pipe body;

a wear pad upset from the drill pipe body, the wear pad comprising a plurality of wear inserts secured within the wear pad and a wear pad material that at least partially encases the plurality of wear inserts, wherein the plurality of wear inserts comprises a hardness greater than a hardness of the wear pad material; and an insert support structure positioned about the drill pipe body, the insert support structure being operable to receive and secure the plurality of wear inserts, the insert support structure being at least partially encased in the wear pad material.

31. The drill pipe of claim 30, wherein the insert support structure comprises a plurality of pockets, wherein one or more wear inserts of the plurality of wear inserts are received within a respective pocket.

32. The drill pipe of claim 30, wherein the wear pad material completely encases the plurality of wear inserts, such that a top of the wear insert and the insert support structure is covered.

33. A drill pipe having a wear pad for resisting wear during downhole drilling, the drill pipe comprising:

a drill pipe body; and a wear pad upset from the drill pipe body, the wear pad comprising a plurality of wear inserts secured within the wear pad and a wear pad material that at least partially encases the plurality of wear inserts, wherein the plurality of wear inserts comprises a hardness greater than a hardness of the wear pad material, wherein the drill pipe body comprises a bend portion that defines and separates a first drill pipe section and a second drill pipe section, wherein the wear pad is attached to the first and second drill pipe sections and extends over the bend portion.

34. A drill pipe having a wear pad for resisting wear during downhole drilling, the drill pipe comprising:

a drill pipe body; and a wear pad upset from the drill pipe body, the wear pad comprising a plurality of wear inserts secured within the wear pad and a wear pad material that at least partially encases the plurality of wear inserts, wherein the plurality of wear inserts comprises a hardness greater than a hardness of the wear pad material, wherein the drill pipe comprises a fixed bent housing for a mud motor, the fixed bent housing comprising a second wear pad formed adjacent the wear pad, the wear pad and the second wear pad being separated from one another about a bend portion of the fixed bent housing.

35. A drill pipe having a wear pad for resisting wear during downhole drilling, the drill pipe comprising:

a drill pipe body; and a wear pad upset from the drill pipe body, the wear pad comprising a plurality of wear inserts secured within the wear pad and a wear pad material that at least partially encases the plurality of wear inserts, wherein the plurality of wear inserts comprises a hardness greater than a hardness of the wear pad material, wherein the wear pad further comprises:

an insert support structure having a recess formed therein; and a plurality of pockets formed in the recess of the insert support structure, wherein one or more wear inserts of the plurality of wear inserts are seated within a respective pocket and mounted to the insert support structure, wherein the wear pad material encases the plurality of wear inserts, such that the wear pad material provides a primary wear surface of the wear pad, and such that the plurality of wear inserts provide a secondary wear surface.

36. A method of forming a wear pad on a drill pipe to resist wear during downhole drilling, the method comprising:

providing a drill pipe body;

securing a plurality of wear inserts to the drill pipe body;

encasing the plurality of wear inserts with a wear pad material to form a wear pad upset from the drill pipe body; and forming a second wear pad on a first pipe section of the drill pipe body, wherein the wear pad is attached to a second pipe section, wherein the first and second pipe sections are separated by a bend portion.

37. The method of claim 36, wherein the secondary wear pad comprises a second plurality of wear inserts and a second wear pad material that at least partially encases the second plurality of wear inserts.

* * * * *